US005938913A

United States Patent [19]

Starcevic et al.

[11] Patent Number: 5,938,913

[45] Date of Patent: Aug. 17, 1999

[54] PROCESS AND DEVICE FOR ELECTROLYTIC TREATMENT OF CONTINUOUS RUNNING MATERIAL

[75] Inventors: Jovan Starcevic, Vienna; Karl Siegmund, Tulbing, both of Austria

[73] Assignee: Andritz-Patentverwaltungs-Gesellschaft m.b.H., Graz, Austria

[21] Appl. No.: 08/838,522

[22] Filed: Apr. 8, 1997

[30] Foreign Application Priority Data

Apr. 12, 1996 [AT] Austria ..... 660/96

[51] Int. Cl.[6] ..... C25F 3/00; C25F 1/00; C25F 7/00

[52] U.S. Cl. ..... 205/137; 205/138; 205/704; 205/705; 205/710; 205/712; 205/717; 205/641; 205/645; 204/206; 204/207; 204/208; 204/211; 204/228

[58] Field of Search ..... 205/704, 705, 205/712, 741, 137, 138, 641, 645; 204/206, 207, 208, 211, 228

[56] References Cited

U.S. PATENT DOCUMENTS 4,370,210 1/1983 Yoshihara et al. ..... 204/211

5,507,924 4/1996 Mikumo et al. ..... 204/211

*Primary Examiner*—Arun S. Phasge

*Attorney, Agent, or Firm*—Alix, Yale & Ristas, LLP

[57] ABSTRACT

Process for electrolytic treatment of continuous running material in which the material runs through an electrolytic liquid and electric potential is applied to the material. In order to guarantee freedom from differential potential in the material to be treated in any form of electrolytic treatment, the differential potential in the treated material is measured after electrolytic treatment and at least the same degree of inverse compensating potential is applied to the material. In an apparatus to implement the process, comprising at least one treatment tank to hold the electrolytic liquid and through which the material being treated is guided by means of guide rolls, as well as comprising at least one pair of electrodes to apply electric potential in the material, at least one device is included to achieve this aim and which is used to measure the differential potential of the treated material, together with at least one pair of additional electrodes connected to an adjustable rectifier, where the device for measuring the differential potential is connected to the controlling part of the rectifier.

19 Claims, 3 Drawing Sheets

PROCESS AND DEVICE FOR ELECTROLYTIC TREATMENT OF CONTINUOUS RUNNING MATERIAL

BACKGROUND OF THE INVENTION

The invention refers to a process for electrolytic treatment of continuous running material in which the material runs through an electrolytic liquid and electric potential is induced to the material, as well as a device to carry out the process, comprising at least one treatment tank to hold the electrolytic liquid and through which the material being treated is fed, as well as at least one pair of electrodes to induce electric potential to the material.

In electrolytic treatment of steel, for example in electrolytic coating or pickling, the rectifiers induce electric potential in the material being treated. In plants with a continuous feed of material, for example steel strip or wire, the potential is normally induced in longitudinal direction. The electric current thus flows through the treated material in longitudinal direction. When doing so, symmetrical electric circuits also make it possible to configure the individual potentials in such a way that the material has no differential potential before and after the treatment. The difficulty here is that of precisely maintaining the distances between pickling material and electrodes. Practice has shown that a difference in potential always remains in spite of every effort being made to guide the material properly and earthing rolls must be provided to compensate for the earth potential. This is necessary above all to protect the equipment (coilers, shears, etc.). The effect of the earthing rolls is, however, restricted and the greater the differential potential, the greater the risk of the treatment material and equipment being damaged by electric sparks. Finally, there are electrolytic treatment processes in which symmetrical circuits cannot be implemented, for example according to AT-PS 399.167, where the cathode and anode areas are separate from one another and a rinsing stage must follow after the cathode area.

SUMMARY OF THE INVENTION

The object of the present invention is thus to neutralize differential potential in the material to be treated in all forms of electrolytic process.

This objective is achieved according to the invention by measuring the differential potential between the material and the earth potential and applying an inverse compensating potential to the potential present in the material so that there is no differential potential at the inlet and/or the outlet.

This provides a large degree of freedom in sizing and designing the electric circuits for electrolytic treatment, at the same time going a long way towards eliminating the risk of damage to the treated material and to the equipment, for example coilers, shears or similar, due to flow of current or sparking. It can also cut the expense of achieving exact guiding of the material and thus, make the treatment more economical.

Preferably the compensating potential is set between positive and negative values in relation to the earth potential, depending on the differential potential measured. In this process variant, material without any differential potential after treatment can be obtained with only one rectifier which is constantly re-adjusted and polarity reversed as required.

According to a further variant of the process, the compensating potential applied to the treated material can be made up of two or more individual potentials, where each individual potential only diverges in one direction from the earth potential and the values of the compensating potentials are set in relation to each other depending on the differential potential measured in the material treated. In this way it is possible to avoid the complicated circuits required to reverse the polarity of a rectifier.

With a device for electrolytic treatment of continuous running material, comprising at least one treatment tank to hold electrolytic liquid, through which the material to be treated is fed by means of guide rolls, and at least one pair of electrodes to apply electric potential in the material, the objective targeted above is also achieved according to the invention by including at least one device for measuring the differential potential between the material and the earth potential and/or the differential potential between material at the inlet and the outlet, as well as at least one pair of additional electrodes connected to an adjustable rectifier. The device for measuring the differential potential is connected in this case to the adjusting part of the rectifier. With this type of treatment cell it is possible to obtain treatment material with no differential potential after any kind of electrolytic treatment process because the presence or the build-up of the slightest differential potential is detected immediately and compensated in the treatment material by inducing inverse potential.

It is of advantage if the control range of the rectifier extends in both directions from the earth potential. Thus, with only one rectifier, i.e. with very little equipment, any amount of residual potential can be compensated in any desired direction.

According to another feature of the invention, at least two pairs of additional electrodes, each connected to an adjustable rectifier, can be found in other embodiments, in which case the device for measuring the differential potential is connected to the controlling parts of both rectifiers. In this variant, two simpler and cheaper rectifiers can be used since their polarity does not have to be reversed.

A further advantage is obtained if the control ranges of the two rectifiers extend in opposite directions from the earth potential, enabling the differential potential of the treatment material to be compensated in any desired direction from the earth potential, in spite of the simple design of the individual rectifiers.

In order to achieve long service life, the invention envisages that the or each electrode with anodic polarity is made of material which is resistant to chemical-anodic corrosion by the electrolytic liquid. In this way it is possible to prevent chemical/anodic corrosion, even with constant adjustments, because there is no need to reverse polarity.

According to a further feature of the invention it is of advantage to locate the device for measuring the differential potential between the treated material and the earth potential directly behind the final electrode or directly in front of the first electrode, preferably outside the treatment tank, in order to take into account all factors which induce potential in the treatment device.

A simple structural and reliable device for measuring the differential potential is a voltmeter or ammeter which makes contact with the material and also with the earthing via any rolls or sliding contacts on the material.

A further variant of the invention enables it to produce material free of any different potential to the earth potential, even without making any contact with the earth potential.

If, for example, the differential potential is measured between two points on the material, preferably between the inlet and the outlet, compensating potential can be induced in the material in such a way that the differential potential prevailing in the strip is compensated. Naturally, this will also compensate the differential potential to the earth potential. The advantage of this process variant is that there is no need to seek and make the right contact to the earth potential.

In the following description, an example of an embodiment of a treatment cell according to the invention will be explained in more detail, with references to the enclosed drawings.

BFIEF DESCRIPTION OF THE DRAWINGS

DETAILED DESCRIPTION OF THE PREFERRED EMBODIMENT

Figure 1:
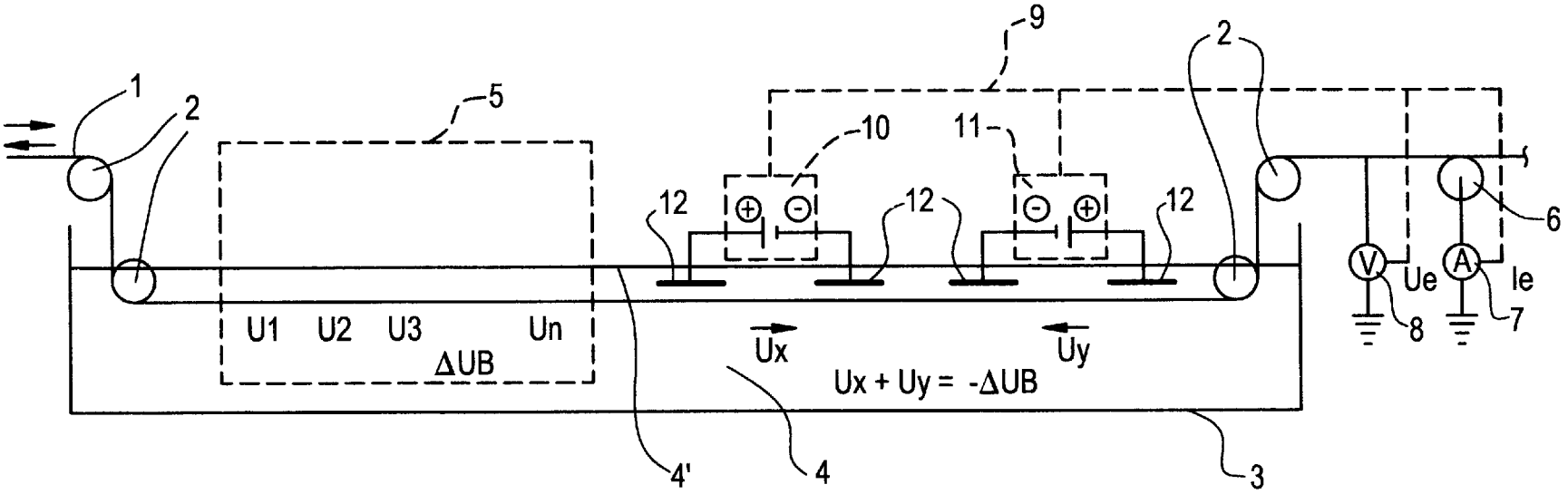
FIG. 1 shows a schematic diagram of a treatment cell with two pairs of additional electrodes and two rectifiers.

The material to be treated, in this case a steel strip or wire 1, is carried over guide rolls 2 through a treatment tank 3 which contains an electrolytic liquid 4. The material 1 is submerged below the liquid level 4'of the electrolyte 4. The box 5 shown with broken lines symbolizes all possible devices, for example, electrodes, rectifiers, conductor rolls, etc., for applying at least one potential of $U_1$ to $U_n$ to the material 1 to be treated. Behind the treatment tank 3 there is an earthing roll 6 which can have an ammeter 7 in its transmission path in order to measure the amount and direction of the current and thus determine the direction and extent of the remaining differential potential in the material 1 after electrolytic treatment 5. In place of this ammeter 7 and earthing roll 6 it is possible to install a voltmeter 8 after the treatment tank 3 in contact with the material 1 in order to determine the differential potential from the drop in voltage. The earthing roll 6 could possibly also be omitted if the differential potential is compensated with sufficient accuracy and reliability by the $\Delta U_B$ treatment.

The ammeter 7 or the voltmeter 8 would then be connected to the control parts of two rectifiers 10, 11 by a control cable 9. Each of these rectifiers 10, 11 is fitted with at least one pair of additional electrodes 1 2, which can be used to apply inverse potentials $U_x$ and $U_y$ of varying amounts to the material 1. It is an advantage here if the electrodes 12 are made of a material which is resistant to chemical and/or anodic corrosion in the electrolyte 4.

The value established for the differential potential ($U_e$, $I_e$) determines which rectifier is activated and to what extent, doing so in such a way that the differential potential is compensated entirely by the $\Delta U_B$ treatment. Instead of two rectifiers it is also possible to use a device whose polarity can be changed to positive or negative potential as required. In addition, several pairs of electrode plates can also be provided for each rectifier. An earthing arrangement provided possibly for safety reasons could be set up using one of the guide rolls 2 or a sliding contact, for example as part of the equipment needed anyway to calculate the differential potential.

In the event of a deviation from the earth potential in only one direction, only one rectifier 10 or 11 and one pair of electrodes 12 would be sufficient. Here, only the exact value of the differential potential would have to be compensated by the $\Delta U_B$ treatment.

Finally, compensation of the differential potential by the $\Delta U_B$ treatment could also be integrated into the electrolytic treatment of the material 1 using the electrodes 12. Thus, in the first treatment section 5 a differential potential ($\Delta U_B$) could be planned whose exact extent could perhaps vary, but which would always be present intentionally so that a differential potential $U_x$ or $U_y$ or ($U_x$–$U_y$) which is exactly diametrically opposite to the differential potential is applied by means of a precisely controllable arrangement of at least one rectifier 10 or 11 and one pair of electrodes 12. In this way, the material 1 would be guaranteed free of differential potential.

Figure 2:
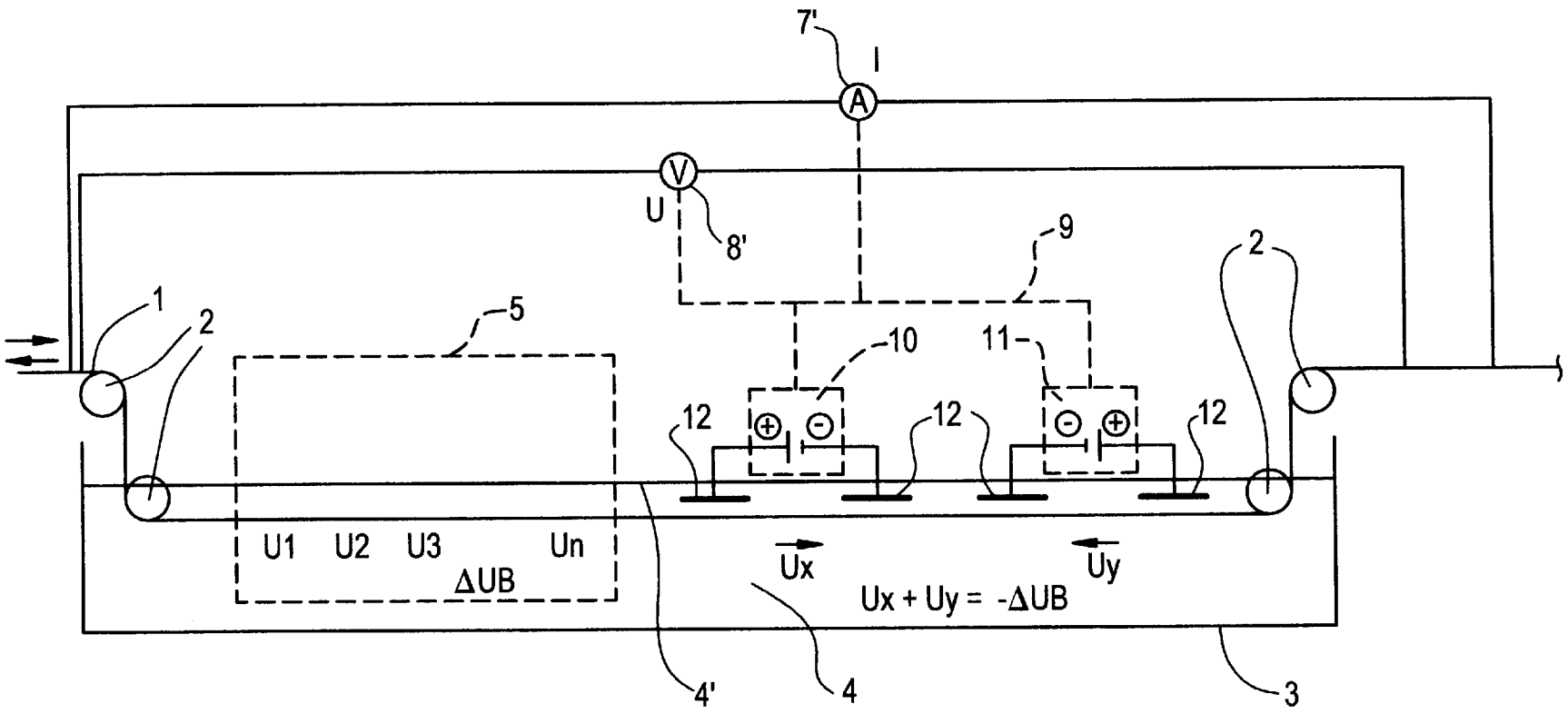
FIG. 2 illustrates a further variant of the invention with measurement of potential between the inlet and the outlet.

FIG. 2 illustrates a plant in which the differential potential (U, I) is measured between the inlet and the outlet of the strip 1 from the tank 3. In this case, the measurement is taken by a ammeter 7' or a voltmeter 8'. All other components are the same as shown in FIG. 1.

Figure 3:
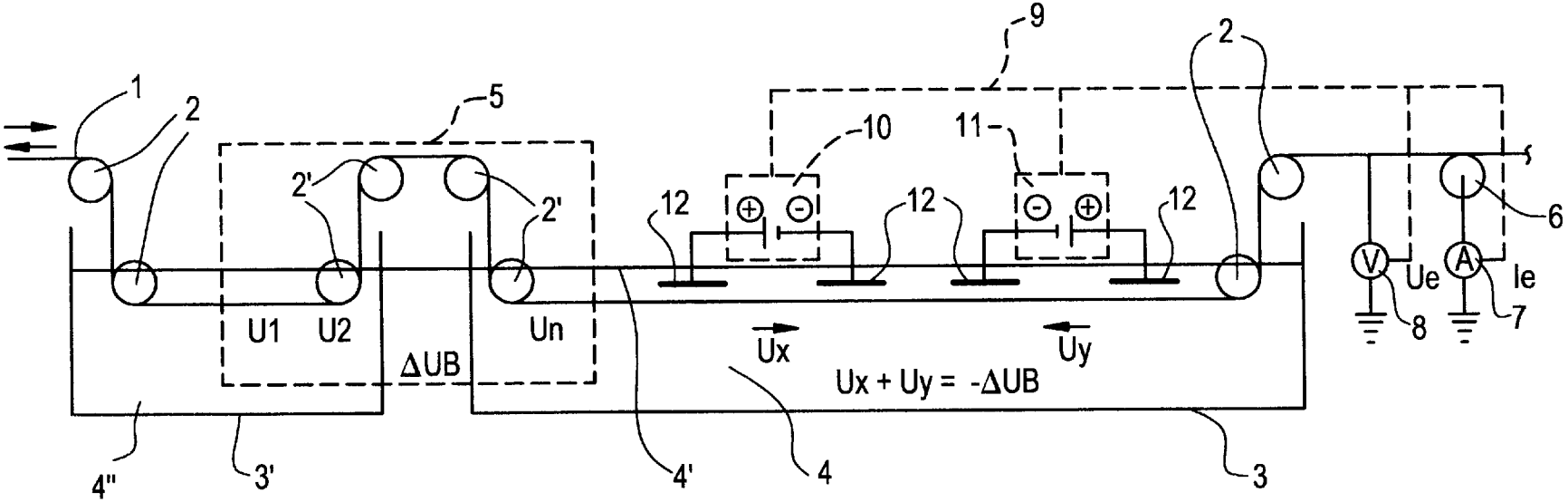
FIG. 3 shows a treatment area comprising two tanks.

FIG. 3 shows a plant similar to the one in FIG. 1. In FIG. 3, however, the treatment section comprises two separate tanks 3, 3' in which different electrolytes 4, 4' can be used. The strip 1 runs over the deflection rolls 2' from the first tank 3' to tank 3. During the treatment process there is a flow of current through the strip from one tank to the other. The electrodes 12 for compensating the potential are located in tank 3, which can either be the inlet or the outlet of the treatment system, depending on the running direction of the strip.

I claim:

1. Process for electrolytic treatment of continuous running material in which electric potential is applied to the material as the material runs into an inlet through an electrolytic liquid out of an outlet, wherein the improvement comprises measuring the differential potential present in the material and applying at least one inverse compensating potential to the differential potential caused by the treatment so that there is no differential potential at the inlet or the outlet.

2. Process according to claim 1, wherein the compensating potential is set between positive and negative values in relation to the earth potential, depending on the differential potential caused by the treatment which the material undergoes.

3. Process according to claim 1, wherein the compensating potential is applied in the treated material, such potential being made up of two or more individual potentials, where each individual potential only diverges in one direction from the earth potential and the values of the compensating potentials are set in relation to each other depending on the differential potential measured.

4. Apparatus for electrolytic treatment of continuous running material, comprising at least one treatment tank having an inlet and an outlet and containing an electrolytic liquid and through which the material being treated is fed, and at least one pair of electrodes for applying an electric potential to the material, wherein the improvement comprises at least one means for measuring the differential potential between the treated material and the earth potential at the inlet and the outlet, and at least one pair of additional electrodes connected to an adjustable rectifier, where each means for measuring the differential potential is connected to the controlling part of the rectifier.

5. Apparatus according to claim 4, wherein the control range of the rectifier extends in both directions from the earth potential.

6. Apparatus according to claim 4, wherein at least two pairs of additional electrodes are available, each connected to an adjustable rectifier, where the means for measuring the differential potential is connected to the controlling part of the rectifier.

7. Apparatus according to claim 6, wherein the control ranges of the two rectifiers extend in opposite directions from the earth potential.

8. Apparatus according to claim 6, wherein each electrode with anodic polarity is made of a material which is resistant to chemical/anodic corrosion by the electrolytic liquid.

9. Apparatus according to claim 6, wherein the device for measuring the differential potential is an ammeter or voltmeter making contact with the material treated, via a roll, and is also in contact with the earth.

10. Apparatus according to claim 4, wherein each electrode with anodic polarity is made of a material which is resistant to chemical/anodic corrosion by the electrolytic liquid.

11. Apparatus according to claim 4, wherein the means for measuring the differential potential in the treated material is located behind the last electrode.

12. Apparatus according to claim 4, wherein the means for measuring the differential potential is an ammeter or voltmeter making contact with the material treated, via a roll, and is also in contact with the earth.

13. Apparatus for electrolytic treatment of continuous running material, comprising at least one treatment tank having an inlet and an outlet and containing an electrolytic liquid and through which the material being treated is fed, and at least one pair of electrodes for applying an electric potential to the material, wherein the improvement comprises at least one means for measuring the differential potential between the treated material and the earth potential at the inlet or the outlet, and at least one pair of additional electrodes connected to an adjustable rectifier, where each means for measuring the differential potential is connected to the controlling part of the rectifier.

14. Device according to claim 13, wherein the control range of the rectifier extends in both directions from the earth potential.

15. Device according to claim 13, wherein at least two pairs of additional electrodes are available, each connected to an adjustable rectifier, where the device for measuring the differential potential is connected to the controlling part of the rectifier.

16. Device according to claim 15, wherein the control ranges of the two rectifiers extend in opposite directions from the earth potential.

17. Device according to claim 13, wherein each electrode with anodic polarity is made of a material which is resistant to chemical/anodic corrosion by the electrolytic liquid.

18. Device according to claim 13, wherein the device for measuring the differential potential in the treated material is located behind the last electrode.

19. Device according to claim 13, wherein the device for measuring the differential potential is an ammeter or voltmeter making contact with the material treated, via a roll, and is also in contact with the earth.

* * * * *